US006421876B1

(12) United States Patent
Ginzel et al.

(10) Patent No.: US 6,421,876 B1
(45) Date of Patent: Jul. 23, 2002

(54) DOOR CLOSER

(75) Inventors: Olaf Ginzel, Dortmund; Rainer Fengler, Stuttgart; Lars Parzanka, Breckerfeld; Roger Migchielsen, Ennepetal, all of (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/540,026

(22) Filed: Mar. 31, 2000

Related U.S. Application Data

(63) Continuation-in-part of application No. PCT/EP99/03113, filed on May 6, 1999.

(30) Foreign Application Priority Data

Aug. 3, 1998 (DE) ..... 198 34 889
Dec. 16, 1998 (DE) ..... 298 22 258 U

(51) Int. Cl.[7] ..... E05F 1/08
(52) U.S. Cl. ..... 16/79; 16/71; 16/72; 16/59
(58) Field of Search ..... 16/79, 58, 62, 16/59, 57, 69, 64, 84, 49, 72, DIG. 21, 51

(56) References Cited

U.S. PATENT DOCUMENTS

| | | | | | |
|---|---|---|---|---|---|
| 3,210,797 | A | * | 10/1965 | Heinitz et al. | 16/58 |
| 3,426,382 | A | * | 2/1969 | Laier | 16/79 |
| 3,546,734 | A | * | 12/1970 | Pollack | 16/79 |
| 4,263,694 | A | * | 4/1981 | Jentsch | 16/48.5 |
| D261,099 | S | * | 10/1981 | Russell | D8/7 |
| 4,394,787 | A | | 7/1983 | Lieberman | |
| D281,762 | S | * | 12/1985 | Okazaki | D8/330 |
| 4,783,882 | A | * | 11/1988 | Frolov | 16/72 |
| 4,847,946 | A | * | 7/1989 | Nam et al. | 16/53 |
| 4,937,913 | A | * | 7/1990 | Jentesh | 16/58 |
| 4,999,872 | A | * | 3/1991 | Jentsch | 16/58 |
| 5,265,306 | A | * | 11/1993 | Yu | 16/51 |
| 5,709,009 | A | * | 1/1998 | Lesson et al. | 16/79 |
| D416,779 | S | * | 11/1999 | Trumpinski et al. | D8/330 |
| D429,992 | S | * | 8/2000 | Ginzel | D8/330 |
| 6,125,505 | A | * | 10/2000 | Jensen et al. | 16/71 |

FOREIGN PATENT DOCUMENTS

| | | |
|---|---|---|
| CH | 455563 | 3/1966 |
| DE | 1141920 | 12/1962 |
| DE | 2245748 | 4/1974 |
| DE | 2405266 | 8/1975 |
| FR | 2319761 | 2/1977 |

OTHER PUBLICATIONS

Excerpt from publication DE Geschmacksmusterblatt Heft 12 vom Jun. 25, 1996, pp. 3017–3018.
Excerpt from publication DE Geschmacksmusterblatt Heft 18 vom Sep. 25, 1996, pp. 4689–4697.
Excerpt from publication DE Geschmacksmusterblatt Heft 19 vom Oct. 10, 1996, p. 1527.
Excerpt from publication DE Geschmacksmusterblatt Heft 20 vom Oct. 25, 1996, p. 5352.
Excerpt from publication DE Geschmacksmusterblatt Heft 4 vom Feb. 25, 1997, pp. 1185–1188.

(List continued on next page.)

*Primary Examiner*—Anthony Knight
*Assistant Examiner*—Mark Williams
(74) *Attorney, Agent, or Firm*—Nils H. Ljungman & Associates

(57) ABSTRACT

A door closer with an oblong, one-piece body such to achieve a compact and aesthetic unit which can be produced with a minimum material consumption. The door closer has lateral faces which each have a curvature and/or bevel that shapes towards each other, which curvature or bevel starts at the lower surface and ends at the upper surface of the door closer. The door closer also has bearing blocks that are built between their fronts and the lateral faces ascending from the body's lower surface.

10 Claims, 6 Drawing Sheets

OTHER PUBLICATIONS

Excerpt from publication DE Geschmacksmusterblatt Heft 9 vom May 10, 1997, pp. 2800–2803.

Excerpt from publication DE Geschmacksmusterblatt Heft 17 vom 1Sep. 10, 1994, pp. 4283–4284.

Excerpt from publication DE Geschmacksmusterblatt Heft 22 vom Nov. 25, 1995, pp. 4949–4950.

Excerpt from DORMA catalog, Door closer DORMA TS 77.

* cited by examiner

DOOR CLOSER

CONTINUING APPLICATION DATA

This application is a Continuation-In-Part application of International Patent Application No. PCT/EP99/03113, filed on May 6, 1999, which claims priority from Federal Republic of Germany Patent Application No. 198 34 889.4, filed on Aug. 3, 1998, as well as Federal Republic of Germany Patent Application No. 298 22 258.2, filed on Dec. 16, 1998. International Application No. PCT/EP99/03113 was pending as of the filing date of the above-cited application. The United States was an elected state in International Application No. PCT/EP99/03113.

BACKGROUND OF THE INVENTION

1. Field of the Invention

The present invention relates to a door closer with an oblong one-piece body which presents an upper surface parallel with regard to a lower surface, two-opposite lateral faces connecting the lower surface and the upper surface, and two fore-parts limiting the body in its longitudinal extension. In the longitudinal extension on the lower surface there are mounting plates sticking out from the fore-parts. The door closer features bearing blocks at both lateral faces in which a drive shaft is rotatably supported to be connected to a rod assembly.

2. Background Information

Such a type of door closer is known under the designation "DORMA TS 77" and is approved thanks to its reliability and the numerous practical application possibilities. The door closer may be mounted on the inner or outer side of a door leaf as well as on a door frame. Generally, mounting the door closer on the door leaf's inside is problematic, as the door leaf during opening is moved in the direction of the adjoining wall and the door closer is then located between the door leaf and this wall. When the opening angle is too important or specific, the door closer incurs or possibly creates the danger to impact on and thus damage the adjoining wall, especially when the door is mounted in a corner of a room or in a thick wall. For the above-mentioned applications, it is suitable to limit the opening angle. It is therefore worth striving for compact door closers presenting substantially simultaneously a minimum overall height, while maintaining the existent application variety as well as their different features.

The already known door closer's external dimensions, especially the overall height, are, due to the specific inside conception, relatively important or specific, resulting in increased package material consumption for packaging and furthermore demanding important stock and transportation space. The door closer's exterior edged shape involves manufacturing problems with regard to hollow spaces in the material and is not acceptable as to an economic use of material.

OBJECT OF THE INVENTION

The problem or object of the present invention is to improve a door closer as discussed above such to provide a compact and aesthetic unit that may be manufactured with a minimum amount of material.

SUMMARY OF THE INVENTION

The object of the invention can be achieved in a door closer as discussed herein, which door closer has lateral faces that take a curved and/or bevelled course towards each other, starting at the lower surface and ending at the upper surface, and in that the bearing blocks are built between their fronts and lateral faces ascending from the lower surface. More inventional beneficial developments of possible embodiments of the present invention are discussed in the features hereinbelow.

The object of the present invention is discussed above presents the advantage that a reduced overall height can be realized with an externally compact shaped door closer. Thus the door closer can also be suitable for use under restricted or inopportune mounting conditions with regard to a limited door leaf opening angle. Generally, a door closer will be preferred which has mechanical and hydraulic units that can be arranged lengthwise in a corresponding channel of the body.

Although for the inventional body the material consumption can be extremely reduced, all characteristics with regard to strength and functionality can essentially be guaranteed. Wall thickness can be essentially reduced to a minimum. The resulting exterior contours are aesthetically designed featuring substantially smooth and seamless transitions. The body can become oblong due to the serial arrangement of its functional units, whereby the lateral faces adapt to the channel's contours. Ideally the lateral faces can take a curved or bevelled course. The exterior contour's smooth course, especially of the lateral faces and of the bearing blocks to be explained hereinafter, can considerably reduce material consumption and problems related to casting technique.

With the intention of obtaining sufficiently stable drive shaft's outlet openings, the lateral faces can present massive block typed reinforcements, that, as far as they are concerned, are designed in a material-saving manner. The connection of these so-called bearing blocks to the body's lower part is exceptionally advantageous. The drive shaft can be arranged such to allow mounting the door closer in different positions.

Furthermore, the drive shaft can be supported and fixed in a suitable axle bore-hole in a manner that allows easy assembling and reduces material consumption.

The reduced external dimensions can decrease the required amount of package material and simultaneously the space required for stock and transportation. Reduced volume and weight can increase packaging density during transportation and furthermore facilitate handling for the fitter on site. Moreover, the aforementioned characteristics considerably contribute to reduce production cost.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

Hereinafter the present invention is explained on the basis of possible execution examples represented by diagrams.

FIG. 11 shows a view of a rod assembly according to one possible embodiment of the present invention.

FIG. 12 shows a view of a rod assembly according to one possible embodiment of the present invention.

FIG. 13 shows a view of a rod assembly according to one possible embodiment of the present invention.

FIG. 14 shows a view of a rod assembly according to one possible embodiment of the present invention.

DESCRIPTION OF THE PREFERRED EMBODIMENT

Figure 2:
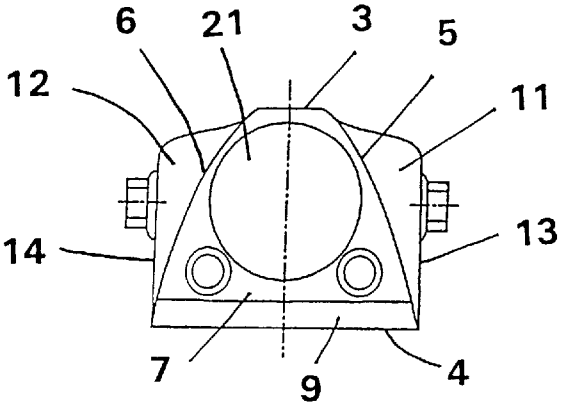
FIG. 2 shows a frontal view of the door closer according to FIG. 1.

In the figures, identical construction units are identified by the same reference numerals. Door closers 1 represented in the different figures are foundry manufactured in one piece and consist for example of aluminium or steel. Despite the optimization aspect to minimize material consumption while maintaining the body's stability, the body 2 is not massive. Generally, all exterior contours and transition surfaces are designed with rounded forms. The door closers 1 are equipped to receive respectively mechanical and hydraulic functional units, which are mounted as already known in linear extension of the body 2 in a channel 21 with the intention to reduce the overall height. A shaft 22 connects the mechanical unit in the body 2 with a rod assembly outside the body 2. The shaft 22 is conducted out of the body 2 at both ends to allow variable mounting of the door closer 1 and the rod assembly with regard to the door leaf and the door frame depending on mounting conditions. For clarity's sake the rod assembly and the mechanical and hydraulic functional units are not represented in FIGS. 1–8. As shown in FIG. 4, a piston 23 and a closing spring 24 are coupled to each other in a displaceable way inside the oblong body 2. The shaft 22 is rotatably supported in the body 2 and presents in its center a toothed wheel 25, which collaborates with a rack 26 inside the piston 23 developed in one piece. Outside the body 2, the shaft 22 is coupled with the non-represented rod assembly.

When opening the door, the shaft 22 is twisted via the rod assembly coupled to the door. The piston 23 is moved in horizontal direction and compresses the closing spring 24. The accumulated opening energy is released as soon as the door is set free, and the closing spring 24 unbends or decompresses and presses the piston 23 in the opposite direction. Through the conversion of the linear movement into a rotation the door is closed again. Hydraulic oil is used inside the body 2 as a damping medium.

The body's presents an axial axle bore-hole 27 to support and connect the shaft 22. The axle bore-hole 27 has a round cross section. According to FIG. 5, the axle bore-hole's 27 upper part presents an edge 28 reducing the cross section. According to the figures, the axle bore-hole's 27 lower part displays a groove 29 for a washer 30. The shaft 22 is designed symmetrically and shows a toothed wheel 25 in its center. Discs 31, 31' are premounted on both sides of the toothed wheel 25. Devices for attaching the rod assembly are found at both shaft 22 extremities. Indeed, the rod assembly is mounted on only one extremity, but depending on the mounting situation, it may be installed on the other extremity. So-called sintering bushings 32, 32', made of ceramics, are employed for bearing purposes on both shaft 22 ends. A tube-shaped bearing shell 33 presents a graduated cross section that ends into an edge border 34. The bearing shell's 33 external faces are at least partially radially enlarged., Hereinafter follows the description of how to mount the door closer:

1. First, a washer 35 is inserted into the bearing shell 33 that represents a pre-mounted unit, and pushed against the edge border 34, and then the sintering bushing 32 is pressed non-detachably against the washer 35. Once the shaping process is finished, a washer 35 and the sintering bushing 32 are fixed non-detachably in the axle bore-hole's 27 upper part. The. washer 30 is inserted into the axle bore-hole's 27 groove in the lower part. After having placed the closer spring 24 and the piston 23 in the channel 21, the shaft 22 is put in place through the axle bore hole's 27 lower part. The shaft 22 slides into the axle bore-hole 27 through the sintering bushing 32 until it hits the channel 21 with the disc 31. The shaft 22 is completely supported and fixed once the bearing shell 33 is placed. The pre-mounted bearing shell 33 is pushed on the shaft 22 and, by means of a predetermined pressure, is definitively positioned in the body 2 and on the shaft 22. Initially the sintering bushing 32 slides on the shaft 22 and on the bearing shell's 33 external faces along the axle bore-hole's 27 inside wall. Due to the partially enlarged bearing shell 33, preferably with a projection, the body 2 surrounding the axle bore-hole 27 is elastically pressed towards the outside. Once passed the groove 29, the body 2 and the projection spring back and the bearing shell 33 is fastened. The shaft 22 is simultaneously axially positioned by the sintering bushing 32 sitting closely to the disc 31.

The body 2 is principally of oblong shape. It presents an upper surface 3 with regard to a lower surface 4. Mounting plates 9, 10 are developed on the lower surface 4 in longitudinal extension, serving to fix the body 2 on a door leaf or a door frame. In longitudinal extension, the lower surface 4 and the upper surface 3 are linked by means of lateral faces 5, 6. The fore-parts 7, 8 are placed vertically with regard to the lateral faces 5, 6 and to the lower surface 4 and the upper surface 3 and limit the body 2 in the longitudinal extension. The mounting plates 9, 10 project from the body 2 at the fore-parts 7, 8.

Figure 1:
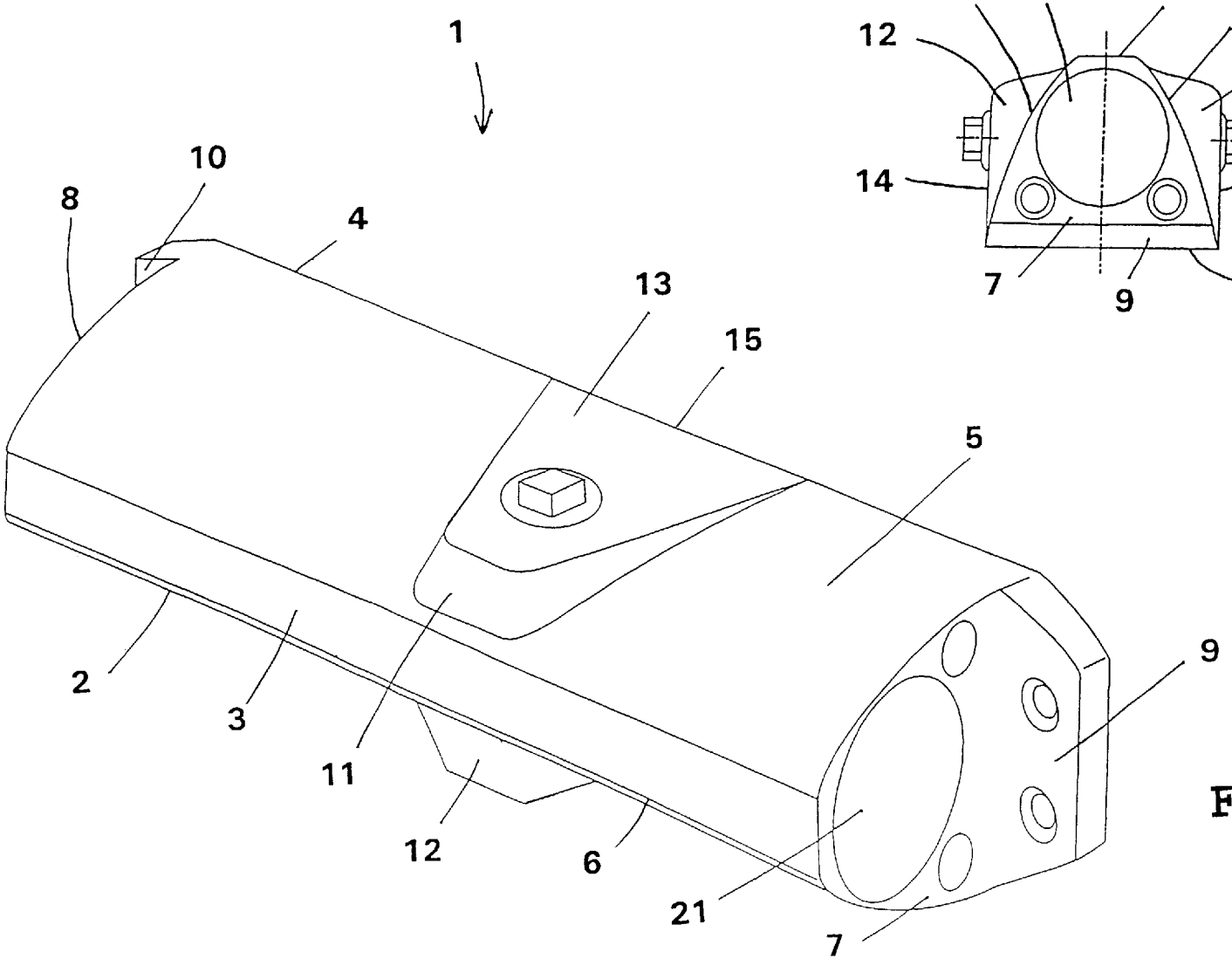
FIG. 1 shows a perspective view of the door closer.
Figure 3:
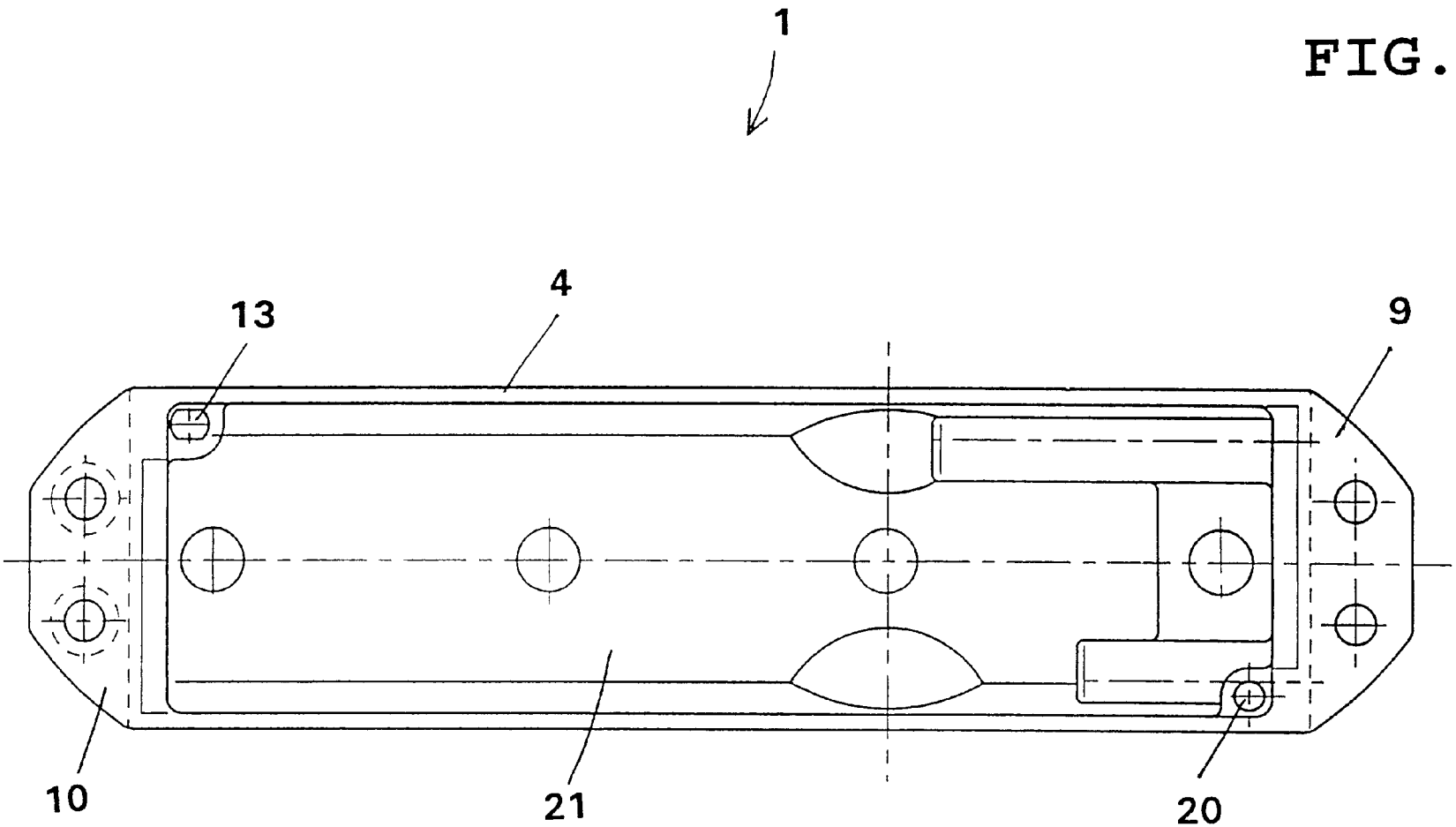
FIG. 3 Shows a view from below of the door closer according to FIG. 1.
Figure 4:
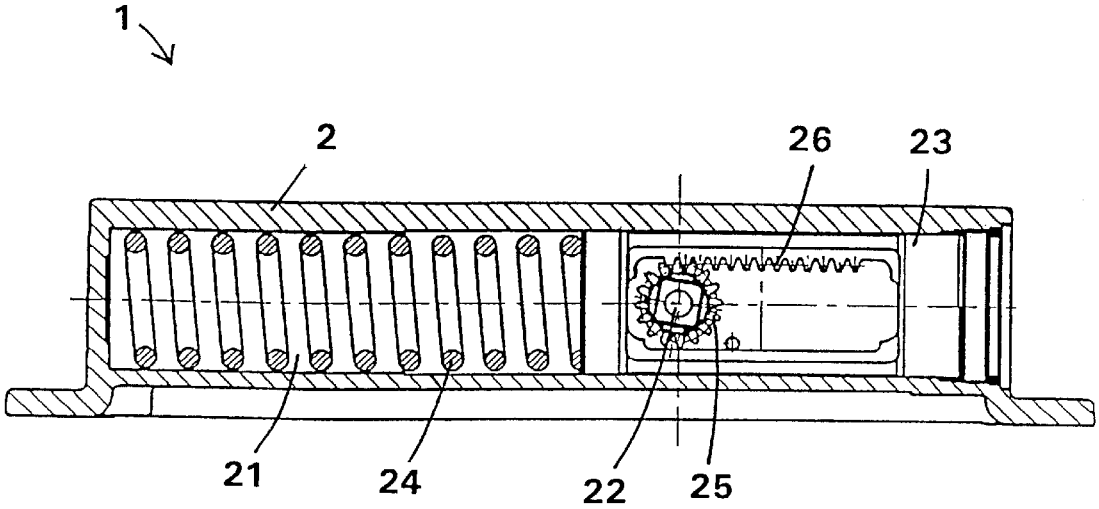
FIG. 4 shows a vertical longitudinal section of the door closer according to FIG. 1.
Figure 5:
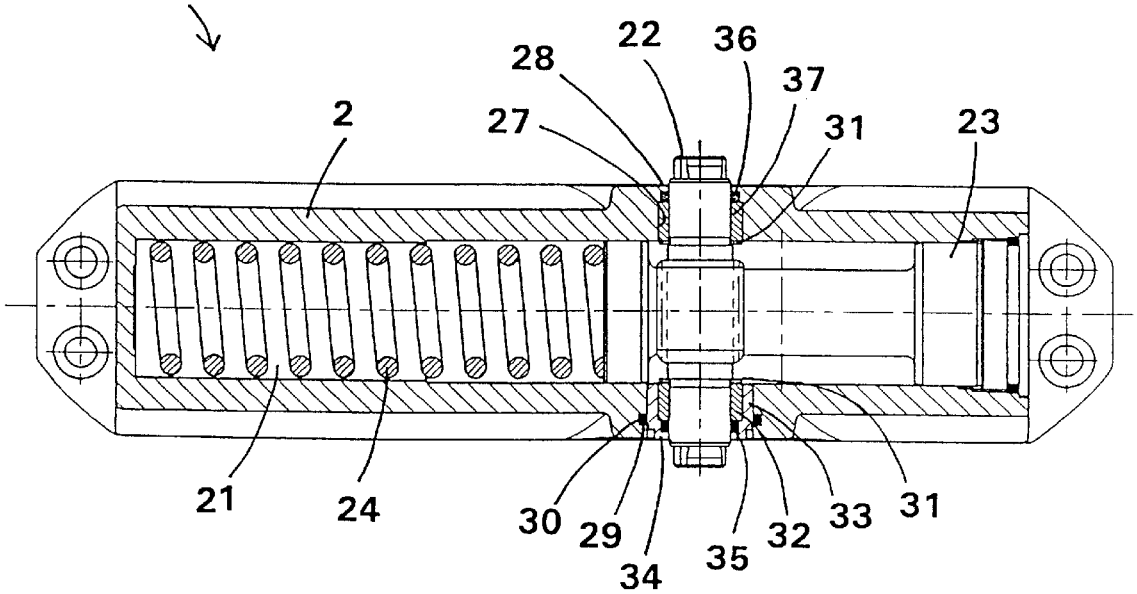
FIG. 5 shows a horizontal longitudinal section of the door closer according to FIG. 1.

The execution example according to FIGS. 1–3 presents the following particularities. When looking at the lower surface 4, the lateral faces 5, 6 show an almost convex curvature, body inwards, and they end at the upper surface 3. The curvature exhibits a parabola type course, whereby the upper surface 3 limits this course. The transition areas between the lateral faces 5, 6 and the upper surface 3 are built by small radii. The shaft is located in the center between the upper surface 3 and the lower surface 4 and off center between the fore-parts 7, 8. This shaft 22 arrangement allows a large variety of mountings for the door closer 1, for example mirror-imaged. The shaft projects out of the body 2 at both lateral faces 5, 6 exactly at bearing blocks 11, 12. The bearing blocks 11, 12 are developed as a massive and one-piece part sitting at the body 2, with the intention to guarantee a stable shaft bearing. The bearing blocks 11, 12 show trapezoidal fronts 13, 14 running vertically with regard to the lower surface 4, whereas the larger base sides 15, 16 are found at the lower surface 4. The bearing blocks' 11, 12 trapezoidal cross section continues at a slightly enlarged scale from the fronts 13, 14 as far as to the lateral faces 5, 6. The bearing blocks 11, 12 are dimensioned such as to not project beyond or past the upper surface 3.

Figure 7:
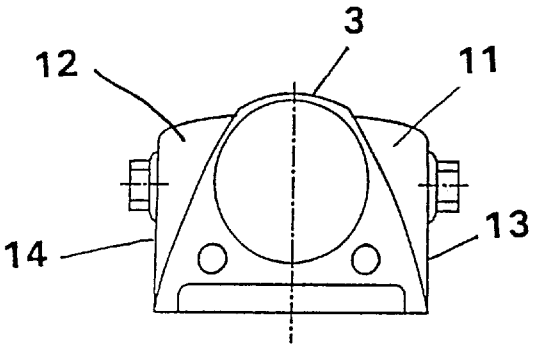
FIG. 7 shows a frontal view of the door closer according to FIG. 4.
Figure 6:
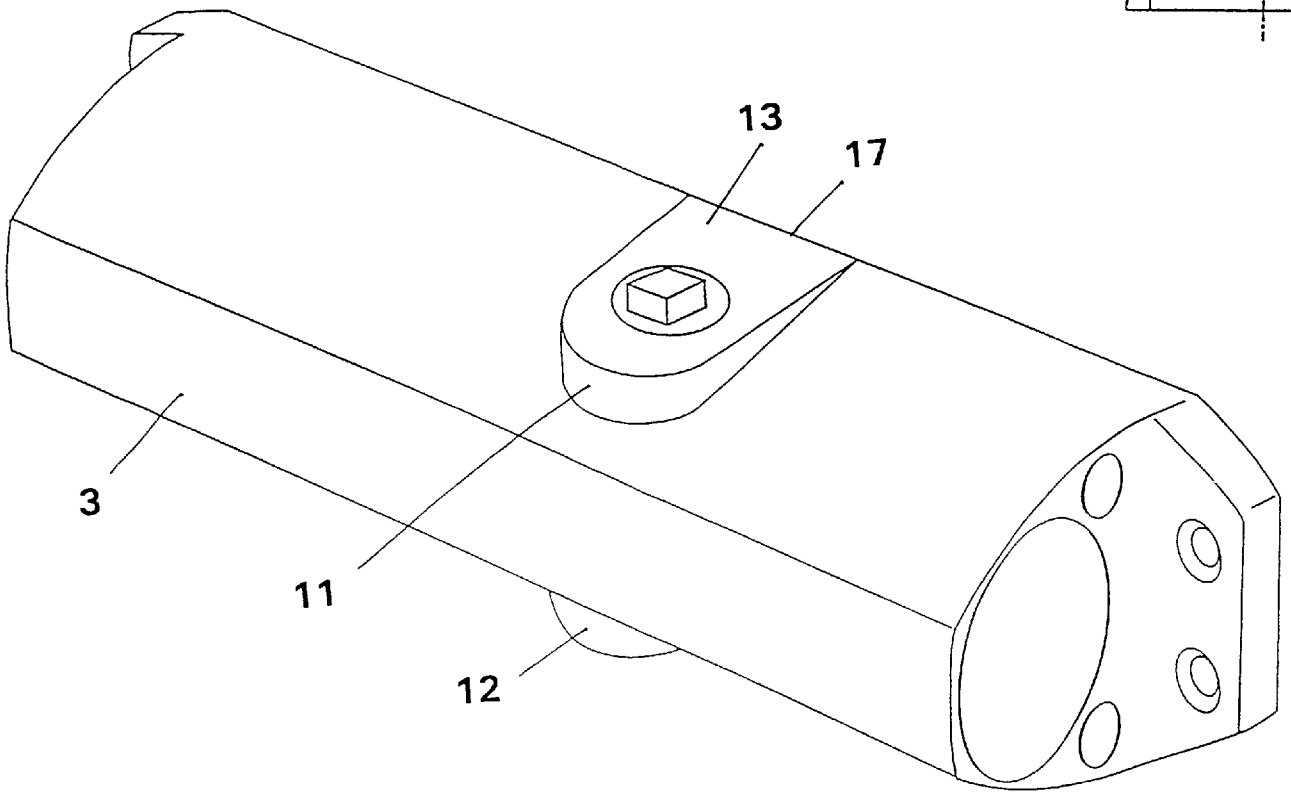
FIG. 6 shows a perspective view of a second door closer execution example.

FIGS. 6 and 7 represent a body 2, the lateral faces 5, 6 of which also exhibit a parabola shape. The upper surface 3 is slightly vaulted with the body outwards, which again saves cast material. The transition areas between the lateral faces 5, 6 and the upper surface 3 also present small radii. The bearing blocks 11, 12 have U-shaped fronts 13, 14 whereby the open sides 17, 18 are located at the lower surface 4. The bearing blocks' 11, 12 U-shaped cross section is slightly enlarged in the direction of the lateral faces 5, 6. The mounting plates 9, 10 are conceived in a bevelled manner in order to save material.

Figure 9:
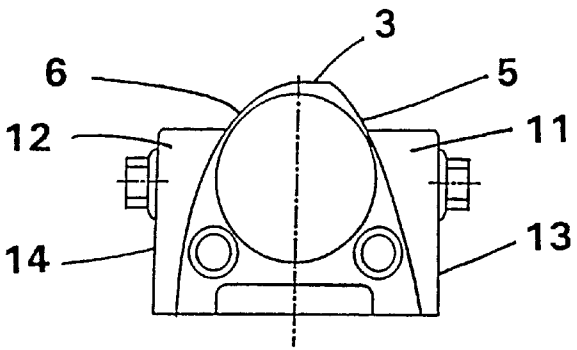
FIG. 9 shows a front view of a door closer according to FIG. 6.
Figure 8:
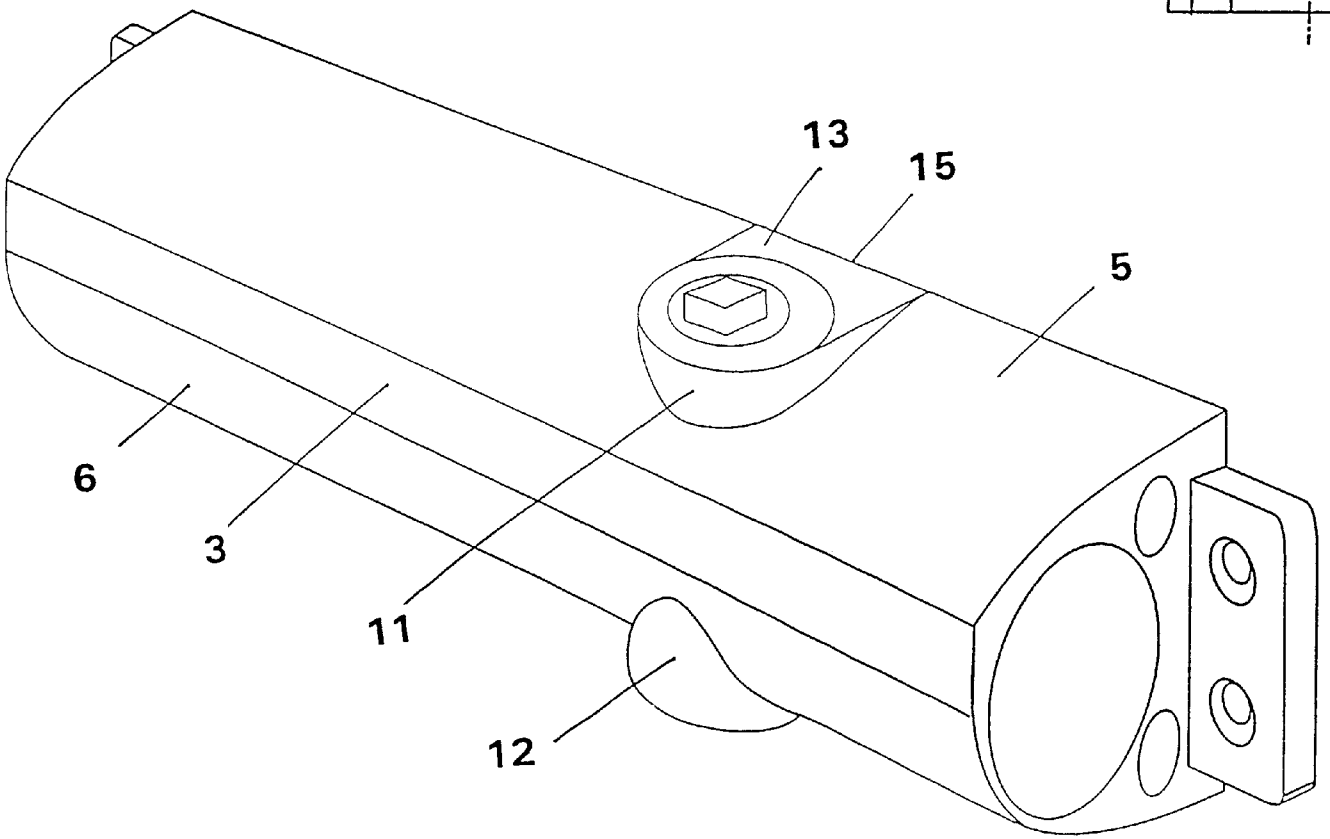
FIG. 8 shows a perspective view of a third door closer execution example.

FIGS. 8 and 9 display a body 2, the lateral faces 5, 6 of which present differing curvatures. The lateral face 5 shows, as already described in the execution example according to FIGS. 1–3, a parabola shape and is limited at a plane upper surface 3. The lateral face 6 presents a different shaped parabola compared to the lateral face 5, in that the lateral face 6 progresses into the upper surface 3, without showing any transition area. Thus on the one side, the upper surface 3 is planar and on the other side it is convex.

All three execution examples have in common, as revealed in FIG. 3, that they present two bore-holes 19, 20 on the lower surface 4. After the casting process, during manufacturing, these bore-holes 19, 20 allow an exact centering and fixing of the machined part for the different workshops. Especially in continuous mechanical manufacturing, mis-adjustments of the machined part are eliminated.

Figure 10:
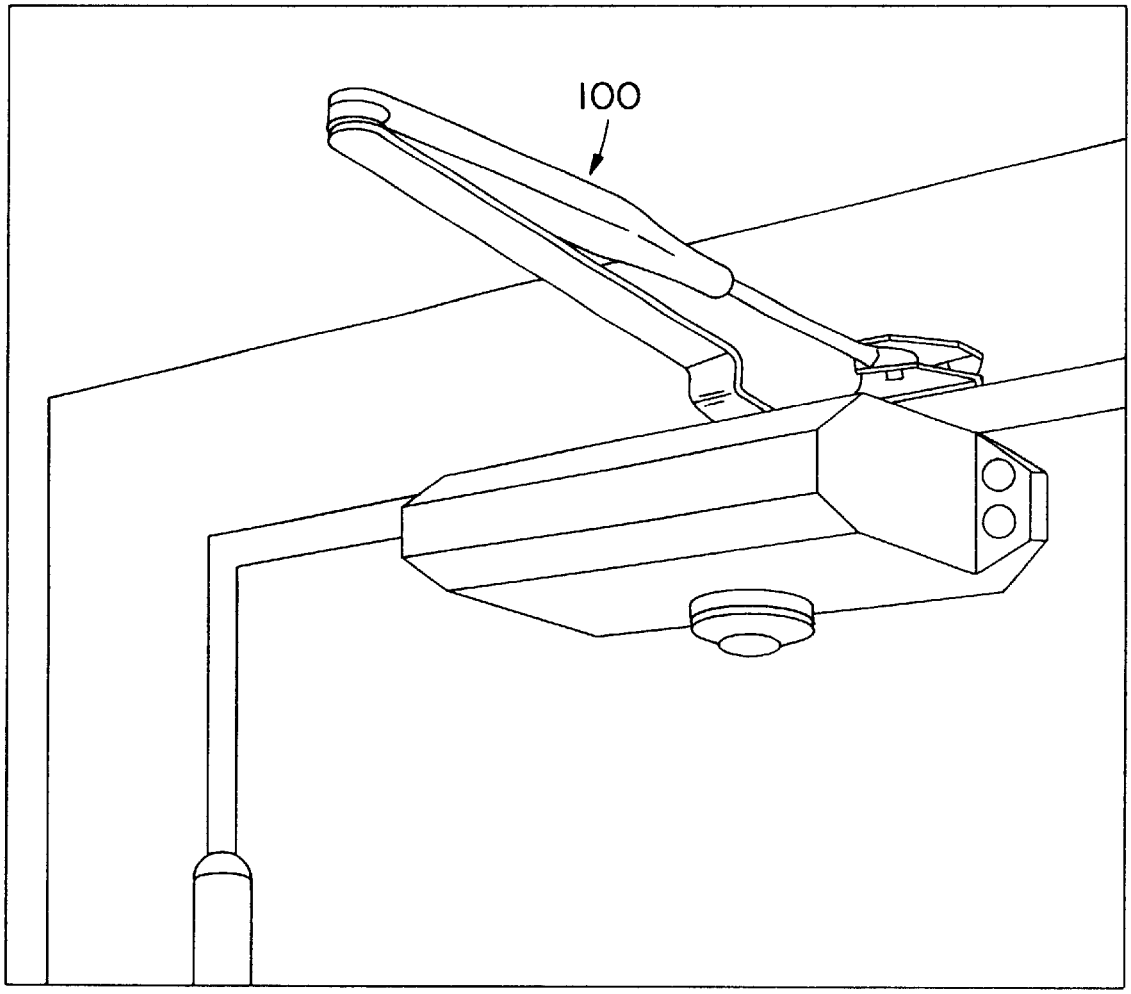
FIG. 10 shows a view of a rod assembly according to one possible embodiment of the present invention.

FIG. 10 shows a view of a rod assembly 100 according to one possible embodiment of the present invention. The rod assembly 100 connects to the shaft 22 (not shown).

FIG. 11 shows a view of a rod assembly 100 according to one possible embodiment of the present invention. The rod assembly 100 connects to the shaft 22 (not shown).

FIG. 12 shows a view of a rod assembly 100 according to one possible embodiment of the present invention. The rod assembly 100 connects to the shaft 22 (not shown).

FIG. 13 shows a view of a rod assembly 100 according to one possible embodiment of the present invention. The rod assembly 100 connects to the shaft 22 (not shown).

FIG. 14 shows a view of a rod assembly 100 according to one possible embodiment of the present invention. The rod assembly 100 connects to the shaft 22 (not shown).

One feature of the invention resides broadly in the door closer 1 with an oblong one-piece body 2 which presents an upper surface 3 parallel with regard to a lower surface 4, two opposite lateral faces 5, 6 connecting the lower surface 4 and the upper surface 3, and two fore-parts 7, 8 limiting the body 2 in its longitudinal extension, which in longitudinal extension on the lower surface 4 displays mounting plates 9, 10 sticking out from the fore-parts 7, 8 and which features bearing blocks 11, 12 at both lateral faces 5, 6 in which a drive shaft 22, is rotatably supported to be connected to a rod assembly, characterized in that the lateral faces 5, 6 take a curved and/or bevelled course towards each other, starting at the lower surface 4 and ending at the upper surface 3, and in that the bearing blocks 11, 12 are built between their fronts 13, 14 and lateral faces 5, 6 ascending from the lower surface 4.

Another feature of the invention resides broadly in the door closer 1 characterized in that the lateral faces 5, 6 present each a differing curvature and/or bevel course.

Yet another feature of the invention resides broadly in the door closer 1 characterized in that the lateral faces 5, 6 describe a parabola shape.

Still another feature of the invention resides broadly in the door closer 1 characterized in that the upper surface 3 is at least partially convex.

A further feature of the invention resides broadly in the door closer 1 characterized in that the bearing blocks 11, 12 present the shape of its fronts 13, 14.

Another feature of the invention resides broadly in the door closer 1 characterized in that the fronts 13, 14 are oriented vertically towards the lower surface 4.

Yet another feature of the invention resides broadly in the door closer 1 characterized in that the fronts 13, 14 have got a trapezoidal or U shape.

Still another feature of the invention resides broadly in the door closer 1 characterized in that the bearing blocks 11, 12 do not project the upper surface 3.

A further feature of the invention resides broadly in the door closer 1 characterized in that the drive shaft 22 is located in the center between the lower surface 4 and the upper surface 3.

Another feature of the invention resides broadly in the door closer 1 characterized in that bore-holes 19, 20 are integrated in the lower surface 4.

Yet another door closer 1 characterized in that the body 2 is made of cast material without having a massive shape.

Still another feature of the invention resides broadly in the door closer 1 characterized in that the shaft 22 is rotatably supported in a bearing shell 33 on one side and the bearing shell 33 may be inserted in the axle bore hole 27 while having an elastic movement of the body 2 and may be fixed on its return spring operation.

A further feature of the invention resides broadly in the door closer 1 characterized in that the shaft 22 has at least partially a larger diameter as the axle bore-hole 27.

Another feature of the invention resides broadly in the door closer 1 with an oblong, one-piece body 2 such to achieve a compact and aesthetic unit which can be produced with a minimum material consumption, lateral faces 5, 6 describe curvature and/or bevel shapes towards each other, starting at the lower surface 4 and ending at the upper surface 3 of the door closer 1, and bearing blocks 11, 12 are built between their fronts 13, 14 and the lateral faces 5, 6 ascending from the body's 2 lower surface 4.

Some examples of linkages or actuator arms which may be utilized or incorporated in a possible embodiment of the present invention may be found in the following U.S. Pat. No. 5,417,013, issued to inventor Tillmann on May 23, 1995; U.S. Pat. No. 5,163,494, issued to inventors MacNeil et al. on Nov. 17, 1992; U.S. Pat. No. 5,149,180, issued to inventors Haab et al. on Sep. 22, 1992; U.S. Pat. No. 5,121,976, issued to inventors Haab et al. on Jun. 16, 1992; U.S. Pat. No. 5,058,238, issued to inventor Lautenschlager on Oct. 22, 1991; U.S. Pat. No. 4,821,375, issued to inventor Kozon on Apr. 18, 1989; U.S. Pat. No. 4,759,099, issued to inventors Morano et al. on Jul. 26, 1988; U.S. Pat. No. 4,669,147, issued to inventor Suchanek on Jun. 2, 1987; U.S.

Pat. No. 4,419,787, issued to inventor Lieberman on Dec. 13, 1983; U.S. Pat. No. 4,285,094, issued to inventor Levings, Jr. on Aug. 25, 1981; U.S. Pat. No. 4,184,382, issued to inventor Redman on Jan. 22, 1980; and U.S. Pat. No. 4,080,687, issued to inventor Jentsch on Mar. 28, 1978.

Some examples of door closers which may be utilized or incorporated in a possible embodiment of the present invention may be found in the following U.S. Pat. No. 5,832,561, issued to inventor Bienek on Nov. 10, 1998; U.S. Pat. No. 5,802,670, issued to inventor Bienek on Sep. 8, 1998; U.S. Pat. No. 5,770,934, issued to inventor Theile on Jun. 23, 1998; U.S. Pat. No. 5,651,216, issued to inventor Tillmann on Jul. 29, 1997; U.S. Pat. No. 5,428,278, issued to inventors Bollengier et al. on Jun. 27, 1995; U.S. Pat. No. 5,417,013, issued to inventor Tillmann on May. 23, 1995; U.S. Pat. No. 5,251,400, issued to inventor Schultze on Oct. 12, 1993; U.S. Pat. No. 4,669,147, issued to inventor Suchanek on Jun. 2, 1987; U.S. Pat. No. 4,501,090, issued to inventors Yoshida et al. on Feb. 26, 1985; U.S. Pat. No. 4,419,787, issued to inventor Lieberman on Dec. 13, 1983; and U.S. Pat. No. 4,285,094, issued to inventor Levings, Jr. on Aug. 25, 1981.

Some examples of drives or electromechanical or electro-hydraulic drives which may be utilized or incorporated in a possible embodiment of the present invention may be found in the following U.S. Pat. No. 5,666,268, issued to inventors Rix et al. on Sep. 9, 1997; U.S. Pat. No. 5,386,885, issued to inventors Bunzl et al. on Feb. 7, 1995; U.S. Pat. No. 5,521,400, issued to inventor Schultze on Oct. 12, 1993; U.S. Pat. No. 5,080,635, issued to inventors Martinez et al. on Jan. 14, 1992; U.S. Pat. No. 4,501,090, issued to inventors Yoshida et al. on Feb. 26, 1985; and U.S. Pat. No. 4,430,846, issued to inventors Presley et al. on Feb. 14, 1984.

Some examples of electronic control or electronic regulation systems which may be utilized or incorporated in a possible embodiment of the present invention may be found in the following U.S. Pat. No. 5,770,934, issued to inventor Theile on Jun. 23, 1998; U.S. Pat. No. 5,666,268, issued to inventors Rix et al. on Sep. 9, 1997; U.S. Pat. No. 5,625,266, issued to inventor Stark on Apr. 29, 1997; U.S. Pat. No. 5,428,278, issued to inventors Bollengier et al. on Jun. 27, 1995; and U.S. Pat. No. 4,838,052, issued to inventors Williams et al. on June 13, 1989.

Some examples of devices or transmissions which may be utilized or incorporated in a possible embodiment of the present invention may be found in the following U.S. Pat. No. 4,763,385, issued to inventors Furch et al. on Aug. 16, 1988, and U.S. Pat. No. 4,744,125, issued to inventors Scheck et al. on May 17, 1988.

Some examples of doors, foldable doors, or door systems and mechanisms and devices for their operation which may be utilized or incorporated in a possible embodiment of the present invention may be found in the following U.S. Pat. No. 5,762,123, issued to inventors Kuyama et al. on Jun. 9, 1998; U.S. Pat. No. 5,651,216, issued to inventor Tillmann on Jul. 29, 1997; U.S. Pat. No. 5,186,230, issued to inventor Ostrander on Feb. 16, 1993; U.S. Pat. No. 5,165,142, issued to inventor Pilsbury on Nov. 24, 1992; U.S. Pat. No. 5,163,494, issued to inventors MacNeil et al. on Nov. 17, 1992; U.S. Pat. No. 5,099,903, issued to inventor Chen on Mar. 31, 1992; U.S. Pat. No. 5,070,926, issued to inventor Behring on Dec. 10, 1991; and U.S. Pat. No. 4,932,455, issued to inventor Yamada on Jun. 12, 1990.

Some examples of movable partition or wall systems and devices for their operation which may be utilized or incorporated in a possible embodiment of the present invention may be found in the following U.S. Pat. No. 5,730,027, issued to inventor Hormann on Mar. 24, 1998; U.S. Pat. No. 5,461,829, issued to inventors Lehto et al. on Oct. 31, 1995; U.S. Pat. No. 5,404,675, issued to inventor Schmidhauser on Apr. 11, 1995; U.S. Pat. No. 5,329,857, issued to inventor Owens on Jul. 19, 1994; U.S. Pat. No. 5,295,281, issued to inventor Kordes on Mar. 22, 1994; U.S. Pat. No. 5,394,648, issued to inventor Kordes on Mar. 7, 1995; U.S. Pat. No. 5,417,013, issued to inventor Tillmann on May 23, 1995; U.S. Pat. No. 5,544,462, issued to inventor Kordes on Aug. 13, 1996; U.S. Pat. No. 5,406,761, issued to inventors Hobbiebrunken et al. on Apr. 18, 1995; U.S. Pat. No. 5,152,332, issued to inventor Siener on Oct. 6, 1992; U.S. Pat. No. 5,042,555, issued to inventor Owens on Aug. 27, 1991; U.S. Pat. No. 4,934,119, issued to inventor Ybarra on Jun. 19, 1990; U.S. Pat. No. 4,914,878, issued to inventors Tamaki et al. on Apr. 10, 1990; U.S. Pat. No. 4,895,246, issued to inventor Rizzi on Jan. 23, 1990; U.S. Pat. No. 4,752,987, issued to inventors Dreyer et al. on Jun. 28, 1988; U.S. Pat. No. 4,596,094, issued to inventors Teller et al. on Jun. 24, 1986; U.S. Pat. No. 4,555,828, issued to inventor Matimura on Dec. 3, 1985; U.S. Pat. No. 4,458,462, issued to inventor Schold on Jul. 10, 1984; U.S. Pat. No. 4,404,770, issued to inventor Markus on Sep. 20, 1983; and U.S. Pat. No. 4,112,647, issued to inventor Scheid on Sep. 12, 1978.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and to scale and are hereby included by reference into this specification.

All, or essentially all, of the components and methods of the various embodiments may be used with at least one embodiment The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The following patents, patent applications, or patent publications, which were cited in the International Search Report dated Sep. 3, 1999, are hereby incorporated by reference as if set forth in their entirety herein: CH 455 563 A, dated March, 1966; FR 2-319 761 A, dated February, 1977; DE 22 45 748 A, dated April, 1974; DE 24 05 266 A, dated August, 1975; U.S. Pat. No. 4,394,787 A; and DE 11 41 920 B, dated December, 1962.

The following patents, patent applications, or patent publications, which were cited in the Information Disclosure Statement filed contemporaneously herewith, are hereby incorporated by reference as if set forth in their entirety herein: Federal Republic of Germany publication "Geschmacksmusterblatt", dated Jun. 25, 1996, pp. 3017–3018; Federal Republic of Germany publication "Geschmacksmusterblatt", dated Sep. 25, 1996, pp.

4689–4697; Federal Republic of Germany publication "Geschmacksmusterblatt", dated Oct. 10, 1996, p. 1527; Federal Republic of Germany publication "Geschmacksmusterblatt", dated Oct. 25, 1996, p. 5352; Federal Republic of Germany publication "Geschmacksmusterblatt", dated Feb. 25, 1997, pp. 1185–1188; Federal Republic of Germany publication "Geschmacksmusterblatt", dated May 10, 1997, pp. 2800–2803; Federal Republic of Germany publication "Geschmacksmusterblatt", dated Sep. 10, 1994, pp. 4283–4284; Federal Republic of Germany publication "Geschmacksmusterblatt", dated Nov. 25, 1995, pp. 4949–4950; and DORMA brochure for door closure model DORMA TS-77.

The corresponding foreign patent publication applications, namely, Federal Republic of Germany Patent Application No. 198 34 889.4, filed on Aug. 3, 1998, and Federal Republic of Germany Patent Application No. 298 22 258.2, filed on Dec. 16, 1998, having inventors Olaf Ginzel, Rainer Fengler, Lars Parzanka and Roger Migchielsen, and DE-OS 198 34 889.4 and DE-OS 298 22 258.2 and DE-PS 198 34 889.4 and DE-PS 298 22 258.2, and International Patent Application No. PCT/EP99/03113, filed on May 6, 1999, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A door closer for closing doors, comprising:

a body having a height, a width and a depth;

said body having a mounting surface and a flat projecting surface opposite the mounting surface;

a distance between said mounting surface and said projecting surface generally comprising the said depth;

a pair of opposed lateral sides each taking a curved, parabolic-shaped course toward each other starting at the mounting surface and ending at the projecting surface for joining the mounting surface to the projecting surface;

said curved lateral sides being parabolic-shaped and said projecting surface being flat in order to provide a compact structure for said body;

said mounting surface having an upper edge and a lower edge;

a distance between said upper edge and said lower edge generally comprising said height;

a first end and an opposite second end for limiting the longitudinal extension of the body;

a first mounting plate and an oppositely-disposed second mounting plate with each mounting plate integrally formed from the body located adjacent the first and second ends and coplanar with the mounting surface;

a pair of oppositely-disposed bearing blocks with each bearing block formed on each respective lateral side;

each bearing block having a bearing block aperture and the bearing block apertures being in axial alignment;

the body further including a circular cylindrical chamber that extends from the first end to the second end and which communicates with each bearing block aperture;

the curvature of said lateral sides generally following the curvature of said circular cylindrical chamber thus providing a not substantially varying thickness between said lateral sides and said chamber to minimize the wall thickness between said circular cylindrical chamber and the curvature of said lateral sides and to minimize the height of said door closer and to maximize door leaf opening angles between a door leaf connected to said door closer and an adjacent wall upon said door closer being mounted in a corner on a door leaf adjacent a wall;

a rotatable shaft set within both bearing block apertures and disposed transverse to said chamber;

an energy storage and release mechanism disposed and configured within said chamber whereupon opening the door causes energy to be temporarily stored by the energy storage and release mechanism and setting the door free causes the energy to be released by the energy storage and release mechanism thereby bringing the door to the closed position;

said shaft including a plurality of gear teeth which are mounted on the portion of said shaft that extends through said chamber; and said energy storage and release mechanism further including:

a rack disposed within said chamber and engageable by said gear teeth for selective linear reciprocable displacement within said chamber;

a piston disposed within said chamber adjacent said rack and linearly displaceable within said chamber as a result of the linear displacement of said rack;

a compression spring disposed within said chamber adjacent said shaft and positioned opposite said rack and said piston and disposed coaxial with said rack and said piston; and said compression spring exerting a linear force on said piston when the door is closed whereupon opening the door causes said shaft to rotate displacing said rack and said piston toward said spring and thus compressing said spring so that said spring temporarily stores energy which is then released when the door is set free thus allowing said spring to relax whereupon said shaft rotates in the opposite direction and said rack and said piston linearly displace away from said spring so that the door closes.

2. The door closer of claim 1, wherein said projecting surface has a partially convex curvature.

3. The door closer of claim 2, wherein each lateral side has a curvature that is different from the curvature of the other of said lateral side.

4. The door closer of claim 3, wherein said body is made from a cast material.

5. The door closer of claim 4, wherein said bearing blocks present a trapezoidal shape.

6. The door closer of claim 4, wherein said bearing locks present a u-shape.

7. A door closer for closing a door, comprising:

a generally oblong-shaped body having a mounting surface and a flat projecting surface opposite said mounting surface;

pair of opposed lateral sides taking a curved, substantially parabolic-shaped course toward each other starting at said mounting surface and ending at said projecting surface for joining said mounting surface and said projecting surface;

said curved lateral sides being substantially parabolic-shaped and said projecting surface being flat in order to provide a compact structure for said body;

a first end and an opposite second end for limiting the longitudinal extension of said body;

a circular cylindrical chamber that extends from said first end to said second end;

the contour of said lateral sides generally following the contour of said circular cylindrical chamber thus maintaining a not substantially varying thickness between said lateral sides and said chamber and thus further to minimize the wall thickness between said circular cylindrical chamber and the curvature of said lateral sides;

said body including an energy storage and release mechanism disposed and configured within said body whereupon opening the door causes energy to be temporarily stored by said energy storage and release mechanism and setting the door free causes the energy to be released by said energy storage and release mechanism thereby bringing the door to the closed position; and a rod assembly for interconnecting said body to the door.

8. The door closer of claim 7, wherein each of said lateral sides has a curvature that is different from the curvature of the other of said lateral sides.

9. The door closer of claim 8, wherein said body is made from a cast material.

10. A method of manufacturing and installing door closers, which door closers are configured to be installed in confined situations of limited door leaf opening angles between the door leaf and the adjacent wall, said door closers comprising a body having a mounting surface and a flat projecting surface opposite the mounting surface; a pair of opposed lateral sides each taking a curved, parabolic-shaped course toward each other starting at the mounting surface and ending at the projecting surface for joining the mounting surface to the projecting surface; said curved lateral sides being parabolic-shaped and said projecting surface being flat in order to provide a compact structure for said body; a first end and an opposite second end for limiting the longitudinal extension of the body; a first mounting plate and an oppositely-disposed second mounting plate with each mounting plate integrally formed from the body located adjacent the first and second ends and coplanar with the mounting surface; a pair of oppositely-disposed bearing blocks with each bearing block formed on each respective lateral side; each bearing block having a bearing block aperture and the bearing block apertures being in axial alignment; the body further including a circular cylindrical chamber that extends from the first end to the second end and which communicates with each bearing block aperture; the curvature of said lateral sides generally following the curvature of said circular cylindrical chamber thus providing a not substantially varying thickness between said lateral sides and said chamber and thus further to minimize the wall thickness between said circular cylindrical chamber and the curvature of said lateral sides; a rotatable shaft set within both bearing block apertures and disposed transverse to said chamber; an energy storage and release mechanism disposed and configured within said chamber whereupon opening the door causes energy to be temporarily stored by the energy storage and release mechanism and setting the door free causes the energy to be released by the energy storage and release mechanism thereby bringing the door to the closed position; said shaft including a plurality of gear teeth which are mounted on the portion of said shaft that extends through said chamber; said energy storage and release mechanism further including: a rack disposed within said chamber and engageable by said gear teeth for selective linear reciprocable displacement within said chamber; a piston disposed within said chamber adjacent said rack and linearly displaceable within said chamber as a result of the linear displacement of said rack; a compression spring disposed within said chamber adjacent said shaft and positioned opposite said rack and said piston and disposed coaxial with said rack and said piston; and said compression spring exerting a linear force on said piston when the door is closed whereupon opening the door causes said shaft to rotate displacing said rack and said piston toward said spring and thus compressing said spring so that said spring temporarily stores energy which is then released when the door is set free thus allowing said spring to relax whereupon said shaft rotates in the opposite direction and said rack and said piston linearly displace away from said spring so that the door closes; said method comprising the steps of:

forming a body having a mounting surface and a flat projecting surface opposite the mounting surface;

forming a pair of opposed lateral sides each taking a curved, parabolic-shaped course toward each other starting at said mounting surface and ending at said projecting surface for joining said mounting surface to said projecting surface;

said parabolic-shaped lateral sides and said flat projecting surface providing a compact structure for said body;

forming a first end and an opposite second end for limiting the longitudinal extension of said body;

forming a first mounting plate and an oppositely-disposed second mounting plate with each of said mounting plates integrally formed from said body located adjacent said first and second ends and coplanar with said mounting surface;

forming a pair of oppositely-disposed bearing blocks with each of said bearing blocks formed on each respective lateral side;

forming in each of said bearing blocks a bearing block aperture and said bearing block apertures being in axial alignment;

forming in said body further a circular cylindrical chamber that extends from said first end to said second end and which communicates with each of said bearing block apertures;

creating a curvature for said lateral sides that generally follows the curvature of said circular cylindrical chamber thus providing a not substantially varying thickness between said lateral sides and said chamber and thus further to minimize the wall thickness between said circular cylindrical chamber and the curvature of said lateral sides;

installing a rotatable shaft within both of said bearing block apertures and disposing said shaft transverse to said chamber;

installing an energy storage and release mechanism disposed and configured within said chamber whereupon opening the door causes energy to be temporarily stored by the energy storage and release mechanism and setting the door free causes the energy to be released by the energy storage and release mechanism thereby bringing the door to the closed position;

forming on said shaft a plurality of gear teeth which are mounted on the portion of said shaft that extends through said chamber;

providing for said energy storage and release mechanism a rack disposed within said chamber and engageable by said gear teeth for selective linear reciprocable displacement within said chamber; a piston disposed within said chamber adjacent said rack and linearly displaceable within said chamber as a result of the linear displacement of said rack;

installing a compression spring within said chamber adjacent said shaft and positioned opposite said rack and said piston for disposition coaxial with said rack and said piston;

installing said compression spring so that said compression exerts a linear force on said piston when the door is closed whereupon opening the door causes said shaft to rotate displacing said rack and said piston toward said spring and thus compressing said spring so that said spring temporarily stores energy which is then released when the door is set free thus allowing said spring to relax whereupon said shaft rotates in the opposite direction and said rack and said piston linearly displace away from said spring so that the door closes;

installing said body for operation in conditions that include confined situations of limited door leaf opening angles between the door leaf and the adjacent wall;

preparing said body for first receiving said spring and said piston within said chamber and then slidably inserting said shaft through said bearing block apertures in order to transversely position said shaft in said chamber; and adjustably mounting said body to either a door leaf or a door frame so that said energy storage and release mechanism compactly disposed with said chamber can automatically close the door immediately after the door is set free.

* * * * *